United States Patent [19]

Elmore et al.

[11] 4,201,258

[45] May 6, 1980

[54] NAIL HOLDER

[75] Inventors: I. James Elmore, Simsbury; Robert F. West, West Simsbury, both of Conn.

[73] Assignee: The Stanley Works, New Britain, Conn.

[21] Appl. No.: 5,440

[22] Filed: Jan. 22, 1979

[51] Int. Cl.[2] ..... B25C 3/00

[52] U.S. Cl. ..... 145/46

[58] Field of Search ..... 145/46, 50 R; 30/271

[56] References Cited

U.S. PATENT DOCUMENTS

| | | | |
|---|---|---|---|
| 187,266 | 2/1877 | George | 30/271 |
| 363,331 | 5/1887 | Hammer | 145/50 R |
| 869,706 | 10/1907 | Hamilton | 145/50 R |
| 960,963 | 6/1910 | Kyle | 30/271 |
| 1,741,109 | 12/1929 | Heimerdinger | 30/271 |
| 2,716,750 | 9/1955 | Biblis | 145/46 |
| 4,079,765 | 3/1978 | Hatayan | 145/46 |

FOREIGN PATENT DOCUMENTS

| | | | |
|---|---|---|---|
| 60590 | 5/1912 | Switzerland | 145/46 |
| 253890 | 12/1948 | Switzerland | 30/271 |
| 1005174 | 9/1965 | United Kingdom | 145/50 R |

*Primary Examiner*—Othell M. Simpson
*Assistant Examiner*—J. T. Zatarga

[57] ABSTRACT

A holder for nails and the like includes a pair of operating members with pivot means biasing the jaw portions of the operating members into normally closed position and with the handle portions being movable towards each other to open the jaw portions. The jaw portions have vertically extending inner side faces and inclined outer side faces tapering from a reduced cross section at the top faces thereof to a broad cross section adjacent the bottom faces thereof. The outer side face of at least one jaw portion may have measuring indicia spaced along one portion of the length thereof, and the pivot means and operating members are desirably integrally formed. To limit the amount of pivotal movement of the operating member handle portions, stops are provided thereon which project towards each other and which are spaced apart a predetermined limited distance in the normal position of the holder.

9 Claims, 7 Drawing Figures

NAIL HOLDER

BACKGROUND OF THE INVENTION

Various devices have been proposed for supporting a nail or brad in position to be struck by a hammer or the like to drive it into the workpiece. These holders enable positioning of short length brads and avoid injuring fingers which often occurs in cramped spaces. Moreover, the fastener may be supported in a vertical position even though the user is well to one side. Such devices date back for more than a century with many patents having been issued during the past century including Dexter U.S. Pat. No. 612,833 and the more recent Hatayan U.S. Pat. No. 4,079,765.

Such devices desirably should be relatively economical and be able to withstand the impacts attendant to use since it is possible for the person wielding the hammer to miss the head of the nail or brad and strike the holder itself, particularly when working from the side or in a cramped space. Moreover, the device ideally should provide for stable seating of the nail or brad in a perpendicular position with respect to the workpiece without requiring the user to provide support or stability thereto except to limit possible movement from the predetermined position.

It is an object of the present invention to provide an improved nail holder of novel configuration which is of simple and durable construction and which is adapted to firmly retain nails, brads and the like in a perpendicular relationship to a workpiece.

It is also an object to provide such a nail holder which may be economically fabricated from impact resistant resins as a one-piece structure and which may additionally include measuring indicia along a portion of the length thereof to facilitate various operations.

Another object is to provide such nail holders wherein the cross sectional configuration of the jaw portions is adapted to transmit impact forces thereon to the workpiece so as to reduce the tendency for crushing, fracturing and the like.

SUMMARY OF THE INVENTION

It has now been found that the foregoing and related objects can be readily attained in a holder for nails and the like which comprises a pair of operating members having an elongated jaw portion, a handle portion and a pivot portion intermediate the jaw and handle portions. Pivot means connect the operating members at their pivot portions and normally biases the jaw portions into contact with each other in the normal condition of the holder with the handle portions being normally spaced apart in its normal condition. However, the handle portions are movable towards each other to open the jaw portions against the biasing pressure of the pivot means to permit insertion of a nail or the like therebetween, and the jaw portions will thus retain the nail with the head thereof projecting outwardly therefrom to facilitate striking by a hammer or the like.

The jaw portions have top faces, bottom faces, opposed generally vertically extending inner side faces and inclined outer side faces which taper from the top faces outwardly from the inner side faces to adjacent the bottom faces to define a reduced cross section at the top face and a broad cross section adjacent the bottom face. The bottom faces of the jaw portions lie in a common plane with the lowest surfaces of the handle portions so that the holder may be stably seated upon a work surface.

In the preferred embodiment, the outer side face of at least one of the jaw portions has measuring indicia spaced along at least a portion of the length thereof. The jaw portions taper to a reduced vertical height adjacent their free ends, and the bottom faces of the jaw portions and the handle portions have recesses therein.

Desirably, the handle portions have stops thereon adjacent their free ends, and these stops project towards each other to abut upon movement of the handle portions towards each other a predetermined distance and thereby to limit such movement. The operating members and pivot means may be integrally formed from a synthetic resin providing self-hinging properties to the pivot means.

To permit most stable placement of the nails and the like, the inner side faces of the jaw portions conveniently have a multiplicity of spaced pairs of vertically extending grooves therein adapted to receive the nails for retention therein. The pairs of grooves are longitudinally spaced along the jaw portions and are of different widths, increasing in diameter from the free ends towards the pivot portions.

BRIEF DESCRIPTION OF THE ILLUSTRATED EMBODIMENTS

DETAILED DESCRIPTION OF THE ILLUSTRATED EMBODIMENT

Figure 1:
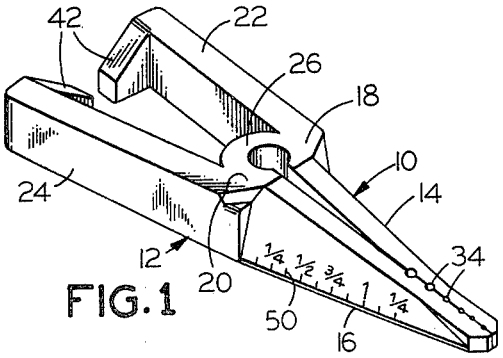
FIG. 1 is a perspective view of a nail holder constructed in accordance with the present invention.

Turning now in detail to the attached drawing, there is illustrated therein a nail holder embodying the present invention which is comprised of a pair of operating members generally designated by the numerals 10,12 and which are interconnected by an integral hinge portion 26. The operating members 10,12 are of symmetrical configuration and include, respectively, jaw portions 14,16 at one end thereof, intermediate pivot portions 18,20 and handle portions 22,24 at the other end thereof.

For convenience, since the operating members 10,12 are of symmetrical configuration, common reference numerals will be employed for the remainder of the description of these elements and surfaces thereof. The operating members 10,12 each have a top face 28, a downwardly and outwardly sloping outer side face 30, a vertically extending inner side face 32 and a bottom face 36. As seen in the several figures, the opposed inner side faces 32 are provided with a multiplicity of pairs of aligned vertical grooves 34 spaced along the length thereof which increase in diameter inwardly from the nose 29 of the jaw portions 14,16. Moreover, it can also be seen that the jaw portions taper downwardly from adjacent the pivot portions 18,20 to a reduced vertical height at the nose portion 29, thus providing a shorter vertical distance enclosing samller diameter nails and brads which frequently tend to be of relatively short length.

Figure 2:
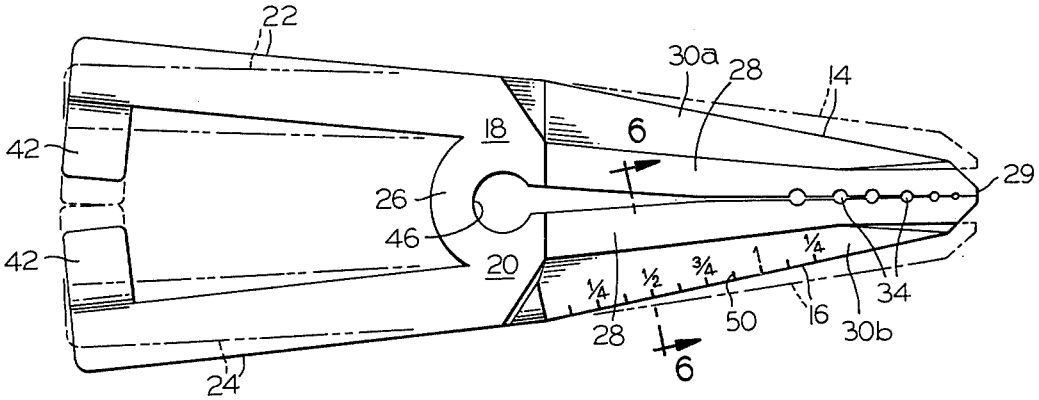
FIG. 2 is a plan view thereof to a greatly enlarged scale with the operating members shown in full line in the normal condition and in phantom line in the opened position thereof to receive a nail between the jaw portions.
Figure 3:
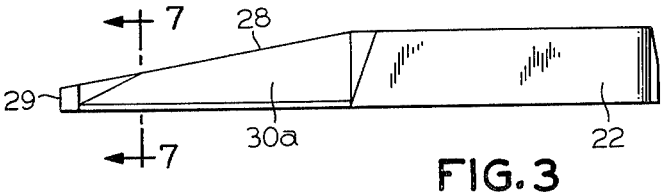
FIG. 3 is a side elevational view thereof to a scale reduced from that of FIG. 2.
Figure 4:
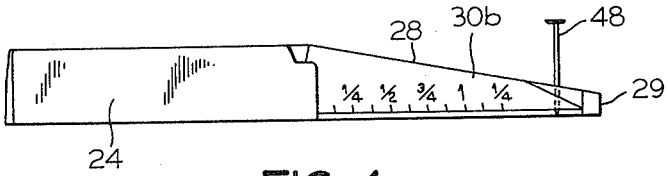
FIG. 4 is a side elevational view of the opposite side from that illustrated in FIG. 3 with a nail vertically supported in one of the aligned pairs of grooves in the jaw portions.

As seen in FIGS. 1, 2 and 4, the outer side face **30*b* of the operating member 12 has measuring indicia 50 formed thereon and spaced over a substantial portion of the length thereof to facilitate the measurements of the length of brads and nails and their location and spacing, as well as to perform other measuring applications. Moreover, it will be noted from FIGS. 3, 6 and 7 that the outer side faces 30 have a short, substantially vertical portion at their lower ends adjacent the bottom faces 36**.

Figure 5:
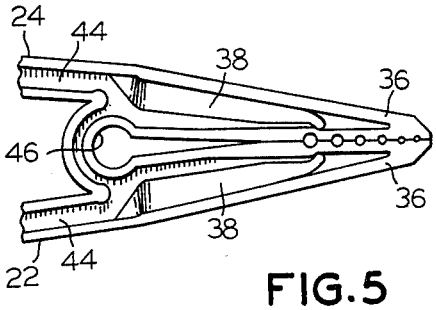
FIG. 5 is a fragmentary bottom view thereof with the nail removed therefrom.
Figure 6:
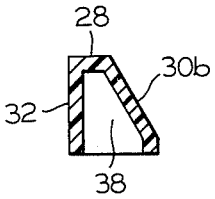
FIG. 6 is a sectional view thereof along the line 6—6 of FIG. 2.
Figure 7:
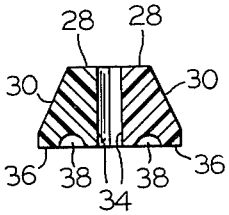
FIG. 7 is a sectional view thereof along the line 7—7 of FIG. 3.

As seen in FIGS. 5–7, the bottom faces of the jaw portions 14,16 have a recess 38 which is deep in the area adjacent the pivot portions 18,20 and shallower adjacent the noses 29 thereof. This recess reduces the amount of material required for fabrication of the jaw portions while retaining sufficient material to ensure adequate strength to resist impacts and provide structural integrity for the unit.

Turning now to the handle portions 22,24, it can be seen that they diverge from the pivot portion 18 in the normal condition of the holder and that there is provided at the free ends thereof a pair of opposed stop portions 42 which are spaced apart in the normal condition of the holder. When the handle portions 22,24 are squeezed to move them towards each other, the stop portions 42 will abut to limit the amount of this movement while permitting the jaw portions 14,16 to be opened sufficiently for insertion of nails and the like. The handle portions 22,24 have recesses 44 in the bottom surfaces thereof to reduce the amount of material employed therein, and these recesses 44 extend through the pivot portions 18,20 to blend into the recesses 38 formed in the jaw portions 14,16.

In the illustrated embodiment, the hinge portion 26 is an arcuate interconnecting member extending between the pivot portions 18,20 of the operating members 10,12 and is integrally formed therewith. As can be seen, an opening 46 between the operating members 10,12 is defined at one end by the arcuate hinge portions 26 bridging the operating members 10,12 and extends between the two jaw portions 14,16 in decreasing width until the inner side faces 32 thereof abut.

In operation of the illustrated embodiment, the handle portions 22,24 are moved towards each other by the user sufficiently to open the jaw portions 14,16 and to enable insertion of the nail or brad 48 in the opposed pair of grooves 34 most closely approximating, but less than, its diameter. The point or tip of the nail or brad 48 normally does not extend below the plane of the bottom faces 36 of the jaw portions 14,16 at the time that the head of the nail or brad 48 is struck. However, the tip may project therebelow to locate the holder in position by being pressed into the workpiece, after which the holder is slid downwardly on the shank of the nail or brad 48 to seat stably upon the surface. The holder is then positioned upon the workpiece (not shown) so as to align the brad or nail 48 with the point of desired entry into the workpiece. A hammer or the like (not shown) is then used to deliver impact forces upon the head of the nail or brad 48 and to drive it into the workpiece sufficiently to stably orient it in the perpendicular position. The holder may then be removed, and the nail or brad 48 driven fully into the workpiece.

As will be appreciated, the nail or brad 48 will slide in the grooves 34 fairly freely under the impact of the hammer blow. In the event that the user should fail to strike the head of the nail or brad 48 and his blow falls upon the upper faces 28 of the jaw portions 14,16, the impact forces are distributed into both the inner side faces 32 and the outer side faces 30 and transmitted by both downwardly to the workpiece, thus generally avoiding destruction of the holder. In this connection, it should be noted that the recess 38 is decreased in dimension as the cross section and vertical dimension, and accordingly the volume, of the resin is diminished in the jaw portions 14,16 from the pivot portions 18,20 to the nose 29.

To facilitate stable placement of the holder upon the workpiece surface, the bottom faces 36 of the jaw portions 14,16 are coplanar with the lowermost surfaces of the handle portions 22,24 and also the hinge portion 26. Thus, there is no tendency for the holder to rock upon the surface of a planar workpiece. Moreover, the tapering width of the jaw portions 14,16 facilitates placement of the holder in relatively narrow areas. The tapering height of the jaw portions 14,16 decreases the amount of the brad or nail 48 which is necessarily confined within the holder; this is particularly advantageous with smaller diameter and smaller length nails and brads.

To facilitate measurement of the length of the nails or brads or the location of the nails or brads at predetermined spacing, at least one of the outer side faces **30*b* is provided with measuring indicia 50 over a portion of its length. If so desired, metric spacing may be employed on the other outer side face 30*a*, or other measuring indicia may be employed on one or both side faces. These measuring indicia 50** also permit utilization of the holder for other applications where a relatively short length measuring device is required, and avoids the delay to obtain a separate rule, tape or the like.

Although metal, wood and ceramics may be employed for the fabrication of the holder, conveniently and most desirably synthetic resin materials are employed therefor. To ensure long life, the resin selected should be one having a substantial degree of resistance to impacts and is conveniently one which is reinforced, conveniently by the addition of materials such as glass fiber. Glass reinforced polyester resins have been found particularly advantageous for this application, although other impact resistant resins such as polycarbonate, polyamide, polypropylene, polyethylene and ABS may also be employed. Polypropylene and polyallomers comprised of polypropylene and polyethylene offer advantages from the standpoint of improved self-hinging characteristics, but satisfactory limited self-hinging characteristics are provided in the glass filled polyesters through the arcuate hinge portion of the illustrated embodiment and the limitations on movement provided by the stops at the free ends of the handle portions.

As will be appreciated, it is highly advantageous to fabricate the holder as a one-piece structure from synthetic resins by injection molding, compression molding and the like. Alternatively, however, the hinge connecting the operating members may be separately formed as in the instance of some of the prior art. By use of the recesses in the bottom faces of the operating members, the volume of resin may be reduced to facilitate fabrication and to decrease cost; however, the structure may be made of solid cross section.

Although the nails or brads may be retained between planar inner side faces on the jaw portions, the use of the pairs of aligned grooves offers significant advantages in assuring perpendicular alignment to the work surface and in facilitating stable placement and retention.

Thus, it can be seen from the foregoing detailed specification and the attached drawing that the novel nail holders of the present invention are of simple but durable construction and adapted to firmly retain nails, brads and the like in a perpendicular relationship to the underlying workpiece. The nail holders may be economically fabricated from impact resistant resins as single piece structures and may additionally include measuring indicia along a portion of the length thereof to facilitate various operations.

We claim:

1. A holder for nails and the like comprising:

A. a pair of operating members each including an elongated jaw portion, a handle portion, and a pivot portion intermediate said jaw and handle portions; and B. pivot means connecting said operating members at said pivot portions thereof and normally biasing said jaw portions into contact with each other in the normal condition of said holder, said handle portions being spaced apart in said normal condition and being movable towards each other to open said jaw portions against the biasing pressure of said pivot means, said jaw portions having top faces, bottom faces, opposed generally vertically extending inner side faces and inclined outer side faces tapering from said top faces outwardly from said inner side faces to adjacent said bottom faces to define a reduced cross section at said top faces and a broad cross section adjacent said bottom faces, said bottom faces of said jaw portions lying in a common plane with the lowest surfaces of said handle portions whereby said holder may be stably positioned upon a work surface, the inner side faces of said jaw portions being adapted to retain a nail or the like therebetween with the head thereof projecting outwardly of said top faces to facilitate striking of the associated nail by a hammer or the like, the outer side face of at least one of said jaw portions having measuring indicia spaced along at least a portion of the length thereof.

2. The holder of claim 1 wherein said jaw portions taper to a reduced vertical height adjacent the free ends thereof.

3. The holder of claim 1 wherein said handle portions have stops thereon adjacent their free ends, said stops projecting towards each other to abut upon movement of said handle portions towards each other a predetermined distance whereby to limit such movement.

4. The holder of claim 1 wherein said inner side faces of said jaw portions have a multiplicity of spaced pairs of vertically extending grooves therein adapted to receive nails or the like for retention therein, said pairs of grooves being longitudinally spaced along said jaw portions and being of different widths.

5. The holder of claim 1 wherein said operating members and pivot means are integrally formed from a synthetic resin providing self-hinging properties to said pivot means.

6. The holder of claim 1 wherein the bottom faces of said jaw portions and the bottom surfaces of said handle portions have recesses therein.

7. The holder of claim 1, wherein said jaw portions taper to a reduced vertical height adjacent the free ends thereof, and wherein the bottom faces of said jaw portions and the bottom surfaces of said handle portions have recesses therein.

8. The holder of claim 7 wherein said inner side faces of said jaw portions have a multiplicity of spaced pairs of vertically extending grooves therein adapted to receive nails or the like for retention therein, said pairs of grooves being longitudinally spaced along said jaw portions and being of different widths.

9. The holder of claim 1 wherein said operating members and pivot means are integrally formed from a synthetic resin providing self-hinging properties to said pivot means, and wherein said handle portions have stops thereon adjacent their free ends, said stops projecting towards each other to abut upon movement of said handle portions towards each other a predetermined distance whereby to limit such movement.

* * * * *